US009616306B2

(12) United States Patent
Jung

(10) Patent No.: US 9,616,306 B2
(45) Date of Patent: Apr. 11, 2017

(54) GOLF HOLE MARKER HAVING A SELF-RIGHTING STRUCTURE

(71) Applicant: Hae Chang Jung, Camarillo, CA (US)

(72) Inventor: Hae Chang Jung, Camarillo, CA (US)

( * ) Notice: Subject to any disclaimer, the term of this patent is extended or adjusted under 35 U.S.C. 154(b) by 184 days.

(21) Appl. No.: 14/615,212

(22) Filed: Feb. 5, 2015

(65) Prior Publication Data

US 2016/0228754 A1 Aug. 11, 2016

(51) Int. Cl.

| | |
|---|---|
| ***A63B 57/00*** | (2015.01) |
| ***G09F 17/00*** | (2006.01) |
| ***A63B 57/30*** | (2015.01) |
| *A63B 71/02* | (2006.01) |
| *A63B 71/06* | (2006.01) |
| *A63B 57/40* | (2015.01) |

(52) U.S. Cl.

CPC ..... *A63B 57/357* (2015.10); *G09F 17/00* (2013.01); *A63B 57/40* (2015.10); *A63B 2071/026* (2013.01); *A63B 2071/0694* (2013.01); *A63B 2210/50* (2013.01); *A63B 2225/09* (2013.01); *G09F 2017/0066* (2013.01)

(58) Field of Classification Search

CPC ..... A63B 57/00; A63B 57/357; A63B 57/40; A63B 2071/026; A63B 2071/0694; A63H 15/06; G09F 17/00; G09F 2017/0066

USPC ..... 116/173; 40/608; 248/910; 446/325, 446/326; 473/176

See application file for complete search history.

(56) References Cited

U.S. PATENT DOCUMENTS

| | | | | | |
|---|---|---|---|---|---|
| 1,228,615 | A | * | 6/1917 | Stafford | E01F 9/629 116/173 |
| 1,439,101 | A | * | 12/1922 | Hatcher | E01F 9/688 40/608 |
| 1,670,525 | A | * | 5/1928 | Savery | A24F 19/0071 220/576 |
| 1,704,248 | A | * | 3/1929 | Heilbrun | B43M 99/003 211/69.5 |
| 2,002,756 | A | * | 5/1935 | Segelhorst | E01F 9/688 116/63 P |
| 2,123,420 | A | * | 7/1938 | Hiser | E01F 9/627 248/160 |
| 2,521,496 | A | * | 9/1950 | Worhun | G09F 17/00 116/173 |

(Continued)

FOREIGN PATENT DOCUMENTS

| | | | | | |
|---|---|---|---|---|---|
| GB | 190823342 | A | * | 0/1909 | |
| GB | 191219390 | A | * | 0/1913 | A63B 57/40 |

(Continued)

*Primary Examiner* — R. A. Smith

(74) *Attorney, Agent, or Firm* — East West Law Group; Heedong Chae

(57) ABSTRACT

A golf hole marker, having a self-righting structure, includes a base, a weighting material received in the base, a telescopic pole and a flag. The base includes a top shell and a bottom shell. The bottom shell is substantially spherically curved and receives the weighting material therein. The top shell has a passage to receive a bottom portion of the pole and a protuberance to press down the weighting material for preventing the weighting material from moving within the bottom shell. The weighting material lowers a center of mass of the golf hole marker lower than a center of the spherically curved bottom shell. Preferably, the base is in the shape of a golf ball.

18 Claims, 7 Drawing Sheets

(56) References Cited

U.S. PATENT DOCUMENTS

| | | | | | |
|---|---|---|---|---|---|
| 3,442,045 | A * | 5/1969 | Green | A63H 15/06 | 446/297 |
| 4,117,455 | A * | 9/1978 | Cervantes | E01F 9/627 | 116/63 P |
| 4,739,302 | A * | 4/1988 | Kinard | E01F 15/003 | 116/63 C |
| 4,750,450 | A * | 6/1988 | Wiegand | G09F 17/00 | 116/173 |
| 5,437,446 | A * | 8/1995 | Youngkin | A63B 69/3676 | 473/257 |
| 5,457,448 | A * | 10/1995 | Totsuka et al. | H04N 5/64 | 340/12.5 |
| 5,606,931 | A * | 3/1997 | Rogers | B60R 13/005 | 116/173 |
| 2009/0305818 | A1* | 12/2009 | Cameron | A63B 57/207 | 473/406 |
| 2015/0328509 | A1* | 11/2015 | Hartwell | G09F 23/0066 | 473/173 |

FOREIGN PATENT DOCUMENTS

| | | | | | |
|---|---|---|---|---|---|
| GB | 373054 | A * | 5/1932 | A63B 57/40 | |
| GB | 2290481 | A * | 1/1996 | A63B 57/10 | |
| JP | 11024563 | A * | 1/1999 | G09F 17/00 | |
| WO | WO 9925431 | A1 * | 5/1999 | A63B 69/0091 | |

* cited by examiner

GOLF HOLE MARKER HAVING A SELF-RIGHTING STRUCTURE

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates to a golf hole marker having a self-righting structure and, more particularly, to a golf hole marker having a base with a self-righting structure, a telescopic pole, a flag, and a direction pointer.

BACKGROUND OF THE INVENTION

Golf hole markers are used to indicate the position of a golf hole on a golf green. These golf hole markers generally have a pole receivable in a golf cup in the hole on a golf green and a flag attached to the upper end of the pole. The poles are relatively long, typically 2 m or more and lower end of the pole is generally provided with a ferrule which is adapted to fit within a socket of the golf cup in the hole for retaining the golf in a upright condition.

Golf hole markers are typically used as a visual indicator of a location of a golf hole on a green. Additionally, they may be used as targets on a practice range, or within cups in a hole on a practice putting or chipping green.

Sometimes, while playing on a green, a golfer may have to ask someone else to hold the golf hole marker received in a golf cup to help him figure out a proper course of the ball. After he hits the ball and while the ball is in motion, the other needs to remove the golf hole marker from the golf cup for preventing the golf hold marker from interfering with the rolling of the ball. However, a golfer may not want to ask someone else to hold a golf hole marker for him, or he may be distracted by the other person holding the golf hole marker.

Besides, a golf hole marker generally do not have a direction indicator to indicate the proper course of a ball on a green. Before putting on a green, a golfer needs to examine the topography of the putting green and determine the intended course of a ball on a green. A direction indicator placed near the golf hole will be a great help to a golfer.

Accordingly, to solve the above problems, a need, for a golf hole marker having a self-righting structure and a direction pointer has been present for a long time considering the expansive demands in the everyday life. This invention is directed to solve these problems and satisfy the long-felt need.

SUMMARY OF THE INVENTION

The present invention contrives to solve the disadvantages of the prior art. The present invention provides a golf hole marker having a self-righting structure.

The object of the invention is to provide a golf hole marker having a self-righting structure, having a base, a weighting material received in the base, a telescopic pole and a flag. The base includes a top shell and a bottom shell. The bottom shell is substantially spherically curved and receives the weighting material therein. The top shell has a passage to receive a bottom portion of the pole and a protuberance to press down the weighting material for preventing the weighting material from moving within the bottom shell. The weighting material lowers a center of mass of the golf hole marker lower than a center of the spherically curved bottom shell. Preferably, the base is in the shape of a golf ball.

Another object of the invention is to provide a golf hole marker having a self-righting structure, having a hollow and substantially spherically curved base, a weighting material received in the base, a telescopic pole and a flag. The pole includes a plurality of concentric tubular sections adapted to slide into one another. Preferably, the base is hemispheric.

Still another object of the invention is to provide a golf hole marker having a self-righting structure, having a base comprised of a top shell and a bottom shell, a weighting material received in the bottom shell, a telescopic pole, and a flag. The bottom shell is substantially spherically curved and further comprises a rim and a ferrule constructed to be received in a socket of a golf cup.

The advantages of the present invention are: (1) the golf hole marker of the present invention provides a self-righting golf hole marker which does not have to be removed when a player makes a stroke and the ball is in motion; (2) because of the self-righting structure, it is easy to place the golf hole marker of the present invention into the center of the golf cup or right next to the hole on the green; (3) the flag indicates the location of a golf hole and the direction pointer indicates the proper course of direction for a ball to get into the hole; (3) the golf hole marker is small and the flag is telescopic, and thus, it is easy to carry or store; (4) the golf hole marker of the present invention is suitable for different circumstances, for example, playing on a putting green, practice range, practice green, or practice mat; and (5) the golf hole marker of the present invention is highly simplified in construction, very durable, and inexpensive to manufacture.

Although the present invention, is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 6(*b*) is a cross-sectional view of the golf hole marker showing the top shell detached from the bottom shell;

FIG. 6(*c*) is a cross-sectional view of the golf hole marker showing the top shell being attached to the recess of the bottom shell;

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
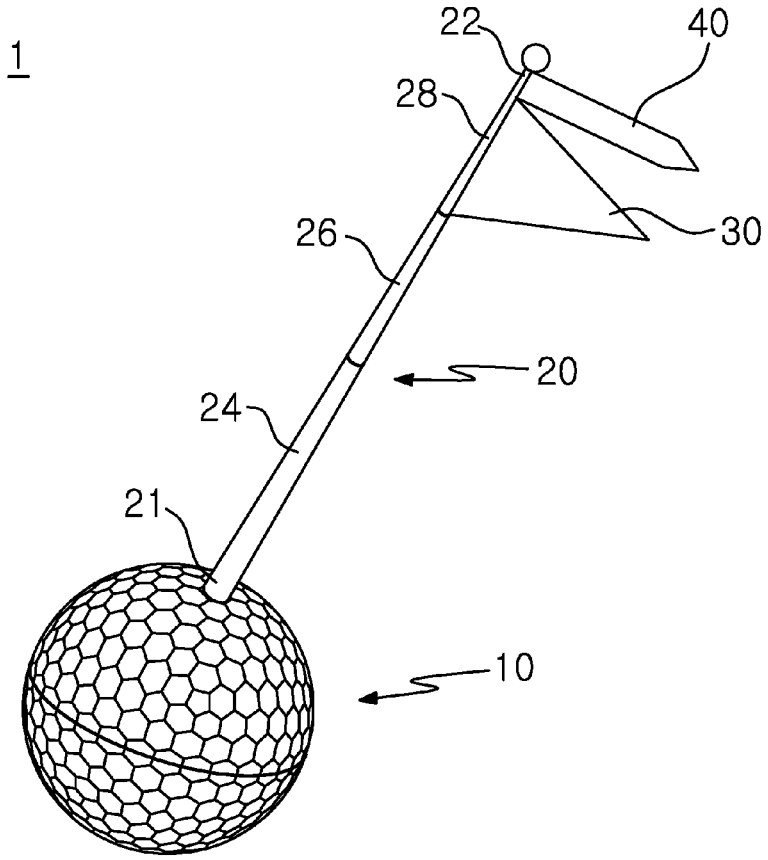
FIG. 1 is a perspective view of the golf hole marker according to one embodiment of the present invention.
Figure 2:
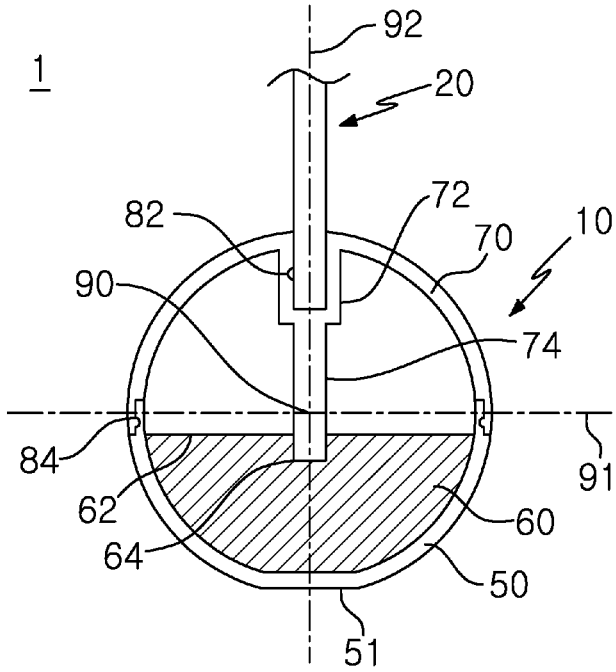
FIG. 2 is a cross-sectional view of the golf hole marker according to one embodiment of the present invention.

FIG. 1 is a perspective view of the golf hole marker 1 according to one embodiment of the present invention and FIG. 2 shows its cross-sectional view.

The golf hole marker 1, having a self-righting structure, comprises a base 10, a weighting material 60 and a pole 20. The base 10 has a substantially spherically curved bottom shell 50 and the bottom shell 50 has a stabilizing bottom 51 to stabilize the golf hole marker 1 in a vertical position when the stabilizing bottom 51 is placed on a horizontal surface such as a flat green 94. The weighting material 60 is received in the bottom shell 50 and the weighting material 80 lowers a center of mass of the golf hole marker 1 lower than a center 90 of the spherically curved bottom shell 50. In addition, the pole 20 is attached to the base 10 and a flag 30 is attached to a top portion 22 of the pole 20. Additionally, a direction pointer 40 may be attached to a top portion 22 of the pole 20. Alternatively, the flag 30 itself may have a direction pointer to point a direction. The pole 20, flag 30 and direction pointer 40 may be detachable.

The golf hole marker 1 has a very low center of gravity, and when rocked upon a flat surface, it will return to rest upon the stabilizing bottom 51. Because of the self-righting structure, if the golf hole marker 1 is tipped over, it will immediately return, automatically to the upright position.

Figure 7:
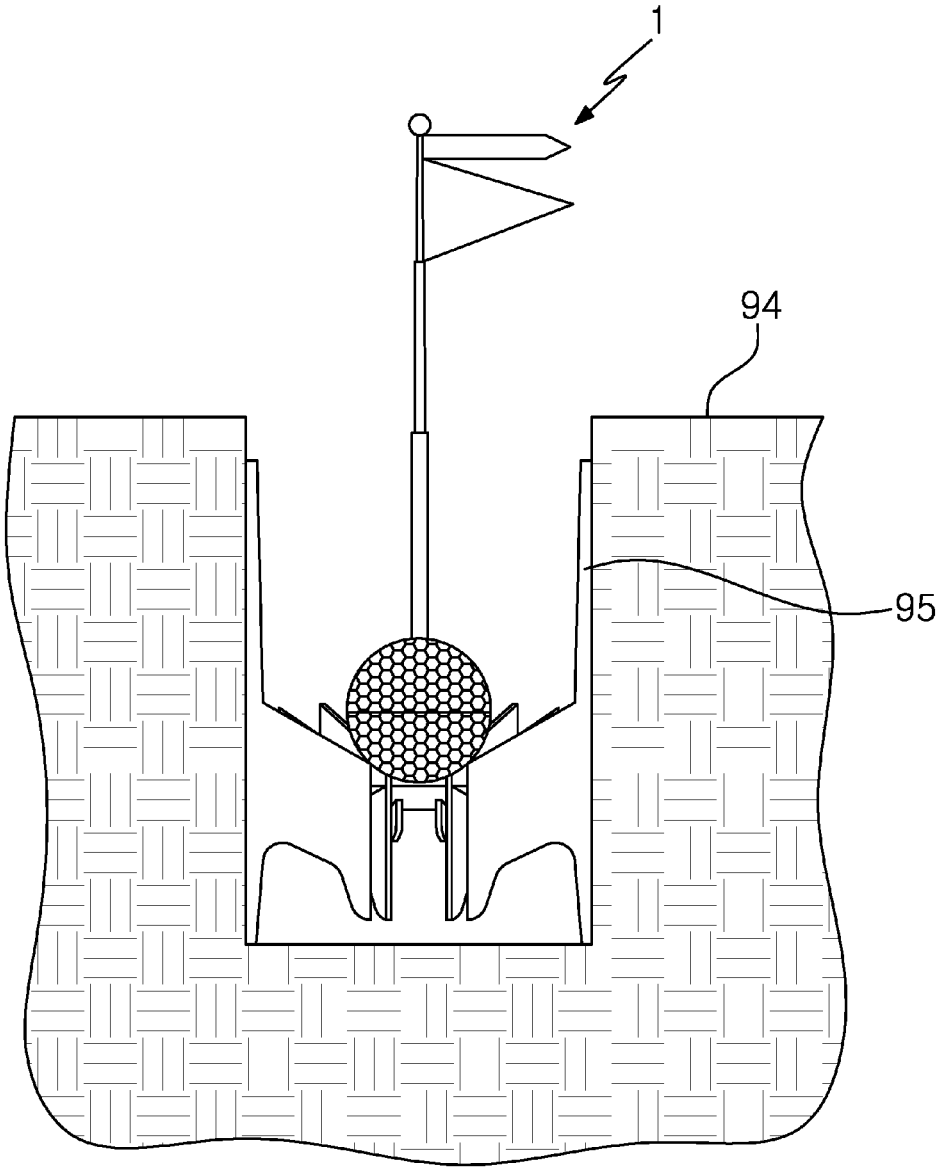
FIG. 7 is a sectional elevational view showing the golf hole marker of the present invention being placed in a golf cup.
Figure 8:
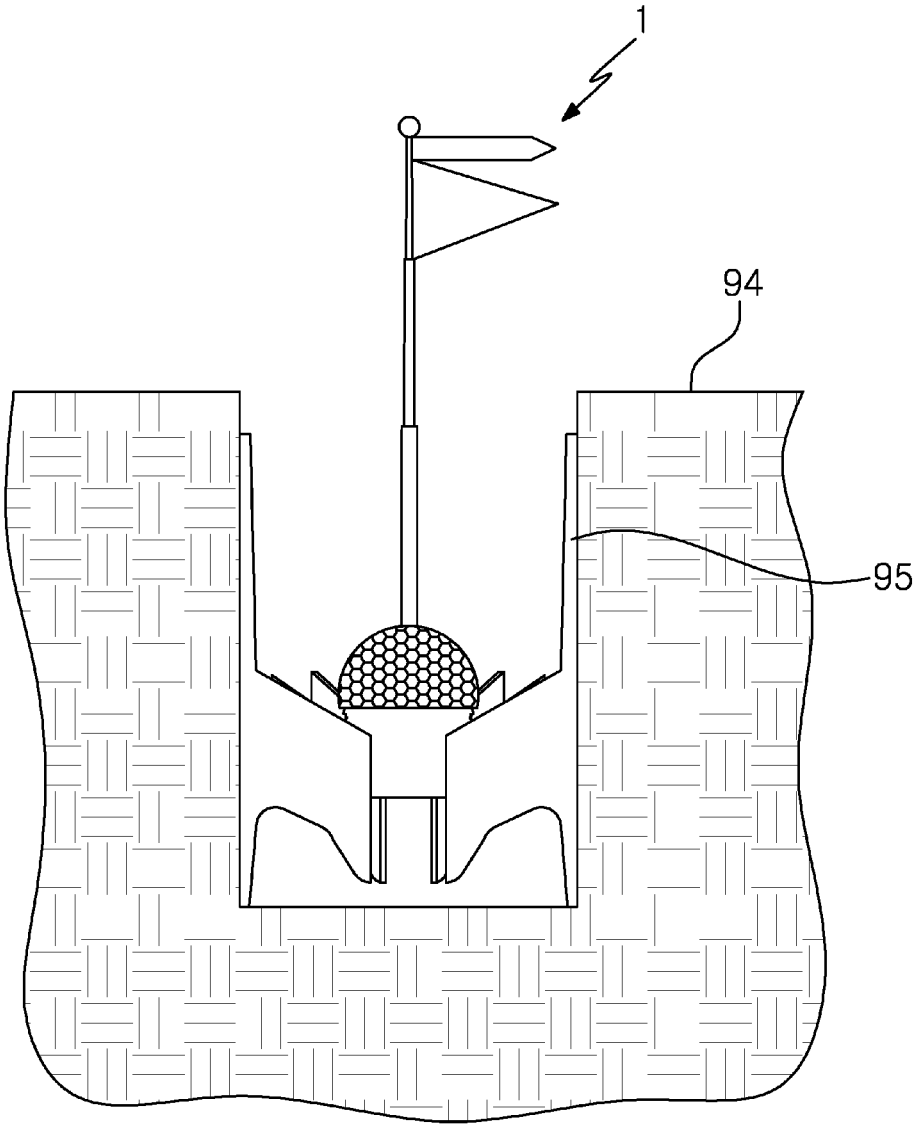
FIG. 8 is a sectional elevational view showing the still another embodiment of the golf hole marker being inserted into the socket of the golf cup.

The center of mass of the golf hole marker 1 is lower than the center 90 of the spherically curved bottom shell 50 (center 90 of the circle conforming to the curve of the bottom shell 50) or the equatorial plane 91 of the spherically curved bottom shell 50. In addition, the central axis 92 of the spherically curved bottom shell 50 may pass through the stabilizing bottom 51 and the pole 20, The primary use of the golf hole marker 1 is as a visual indicator within a cup provided in a green as shown in FIG. 7 or 8. However, the golf hole marker 1 may also be used on a practice range, a practice green, a practice mat or other known uses to indicate the location of the hole for golfers. The golf hole marker 1 may be placed within a cup 95 or right next to the hole on a green 94.

The flag 30 may be made of a cloth, nylon or plastic to serve as an additional visual indicator of the hole for golfers. The direction pointer 40 is to point the proper course of the ball to get into the hole. A golfer may examine the topography of the putting green and determine the direction of a ball in order for it to get into the hole. Then, he may rotate the direction pointer 40 to indicate the angle he determined. Furthermore, the flag 30 may be made as a weather vane attached to the pole 20 or the flag 30 may have the function of a weather vane to indicate the direction of the wind.

Figure 3:
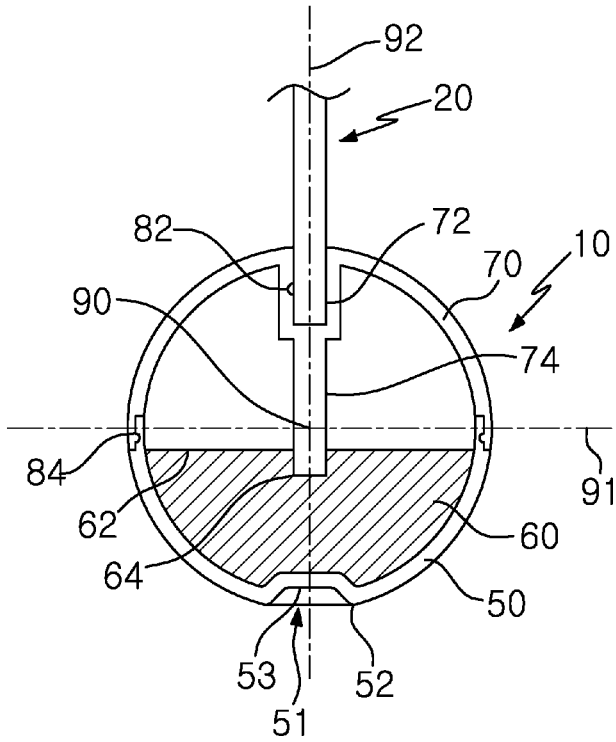
FIG. 3 is a cross-sectional view of the golf hole marker having a different type of a stabilizing bottom according to one embodiment of the present invention.

The stabilizing bottom 51 may be flat to support the golf hole marker 1 as in FIG. 2, or it may comprise a circular ridge 52 and a recess 53 such that the golf hole marker 1 rests upon the circular ridge 52 when placed on the horizontal surface as shown in FIG. 3.

The base 10 further comprises a top shell 70 having a passage 72 to receive a bottom portion 21 of the pole 20 and a protuberance 74 to hold the weighting material 60 for preventing the weighting material 60 from moving within the bottom shell 50. Preferably, the top shell 70 and bottom shell 50 are detachably attached to each other to form a shape of a sphere like a golf ball as shown in FIG. 1. The top shell 70 and the bottom 50 shell may be detachably or fixedly attached to each other. Alternatively, the top shell 70 may be upwardly elongated and tapered and such tapering may continue upwardly by the tapering of the pole 20.

The dimple pattern of the golf ball surface may be printed on the surface of the sphere of the base 10 or the dimples may be formed on the surface of the base 10.

The pole 20 is, preferably detachably, attached to the top shell 70 by a pole attachment means 82 and the top shell 70 is, preferably detachably, attached to the bottom shell 50 by a first shell attachment means 84. The passage 72 may be threaded so that the pole 20 can be attached thereto by screwing the pole 20 onto the passage 72. Alternatively, the pole 20 may be retained within the passage 72 by friction fit, adhesive, pins, crimping, or other known mechanisms. FIG. 2 shows one example of the pole attachment means 82 which is a projection mated with a mating recess of the passage 72.

The top shell 70 may include a circumferential groove 85 that act as retaining structures to help hold the bottom shell 50 in engagement with the top shell 70. As an alternative, or in addition to, the circumferential groove 85, other retaining structures such as ribs, threads, or other projections, may be used to help maintain the top shell 70 firmly in position in engagement with, the bottom shell 50.

The weighting material 60 is substantially spherically curved, conforming to the inner-spherical-curve of the bottom shell 50. The weighting material 60 may be made of heavy material such as metal, for example, zinc (Zn), cast lead, metal alloy, iron and so forth. The weighing material 60 has a top surface 62 and a recess 64. The recess 64 is formed on the top surface 62 to receive a bottom of the protuberance 74 therein.

The pole 20 is preferably telescopic, having a plurality of concentric tubular sections 24, 26 and 28 adapted to slide into one another.

FIG. 7 is a sectional elevational view showing the golf hole marker 1 of the present invention being placed in a golf cup 95.

Figure 4:
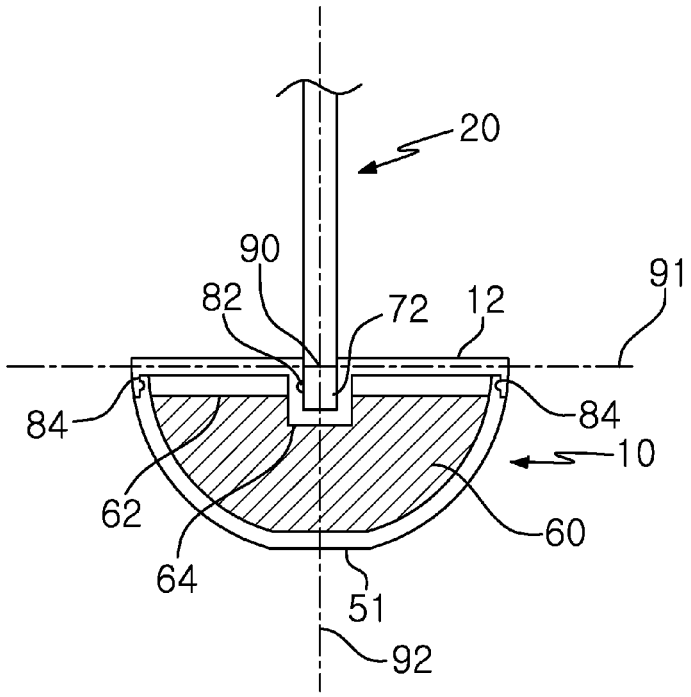
FIG. 4 is a cross-sectional view of the golf hole marker according to another embodiment of the present invention.

FIG. 4 is a cross-sectional view of the golf hole marker 1 according to another embodiment of the present invention.

Figure 5:
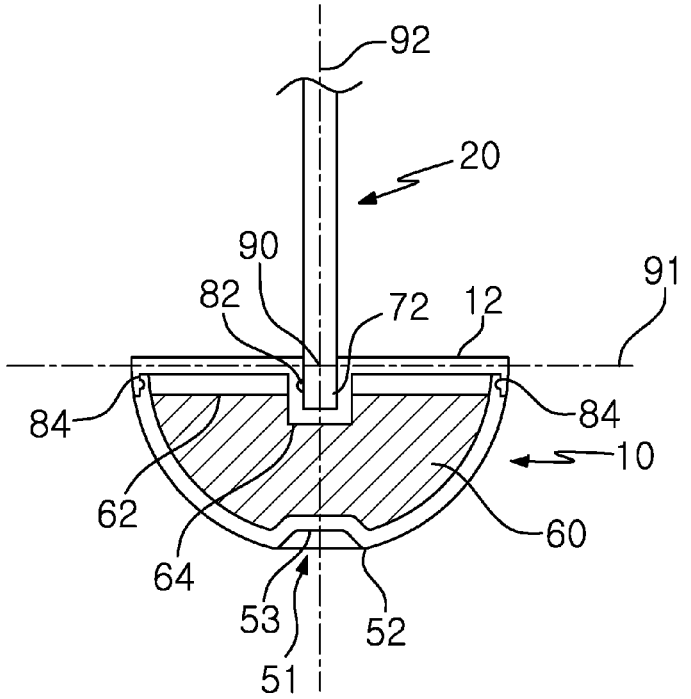
FIG. 5 is a cross-sectional view of the golf hole marker having a different type of a stabilizing bottom according to another embodiment of the present invention.

The golf hole marker 1, having a self-righting structure, comprises a base 10, a weighting material 60, and a pole 20. The base 10 is hollow and substantially spherically curved. The base 10 has a stabilizing bottom 51 to stabilize the golf hole marker 1 in a vertical position when the stabilizing bottom 51 is placed on a horizontal surface. The weighting material 60 is received in the base 10 and the weighting material 60 lowers a center of mass of the golf hole marker 1 lower than a center 90 of the spherically curved base 10. The pole 20 is, preferably detachably, attached to the base 10, The stabilizing bottom 51 may be flat as shown in FIG. 4, or the stabilizing bottom 51 may comprise a circular ridge 52 and a recess 53 as shown in FIG. 5 such that the golf hole marker 1 rests upon the circular ridge 52 when placed on the horizontal surface.

The base 10 has a top surface 12 and a passage 72. The passage 72 is, preferably downwardly, formed on the top surface 12 and receives a bottom portion 21 of the pole 20. The passage 72 may additionally extend upwardly of the top surface 12. The bottom of the passage 72 is received by a recess 64 of the weighting material 60 formed on a top surface 62 of the weighting material 60 so that the passage 72 holds the weighting material 60 for preventing the weighting material 60 from moving within the base 10. The weighting material 80 is substantially spherically curved, conforming to the inner-spherical-curve of the base 10.

A flag 30 is, preferably detachably, attached to a top portion 22 of the pole 20 and a direction pointer 40 may be, preferably detachably, attached to a top portion 22 of the pole 20. Alternatively, the flag 30 may have a direction pointer.

Preferably, the pole 20 is telescopic and the pole 20 may comprise a plurality of concentric tubular sections 24, 26, and 28 adapted to slide into one another. The plurality of sections 24, 26, and 28 telescopes upwardly and locking mechanisms limit expansion of each section and fix its position with respect to adjacent sections. Preferably, the locking mechanisms involve upwardly tapering tubular sections which are made of plastic. Upward extension of the sections 24, 26, and 28 is stopped by a friction fit between adjacent sections. Alternatively, sections 24, 26, and 28 may be locked by cam lock, pins, snap rings, levered cams, threaded collars screwed down onto tapered threads, or any other known means for locking two telescoping sections together.

Figure 6A:
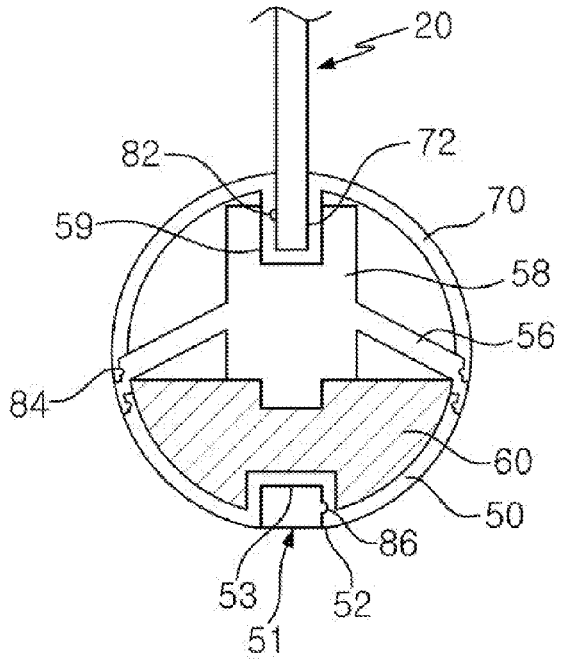
FIG. 6(*a*) is a cross-sectional view of the golf hole marker according to still another embodiment of the present invention.
Figure 6B:
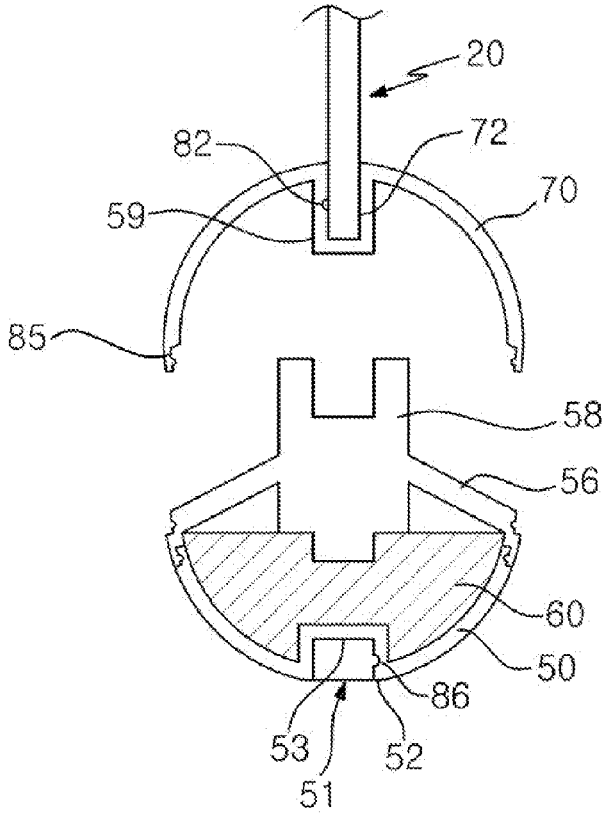
Figure 6C:
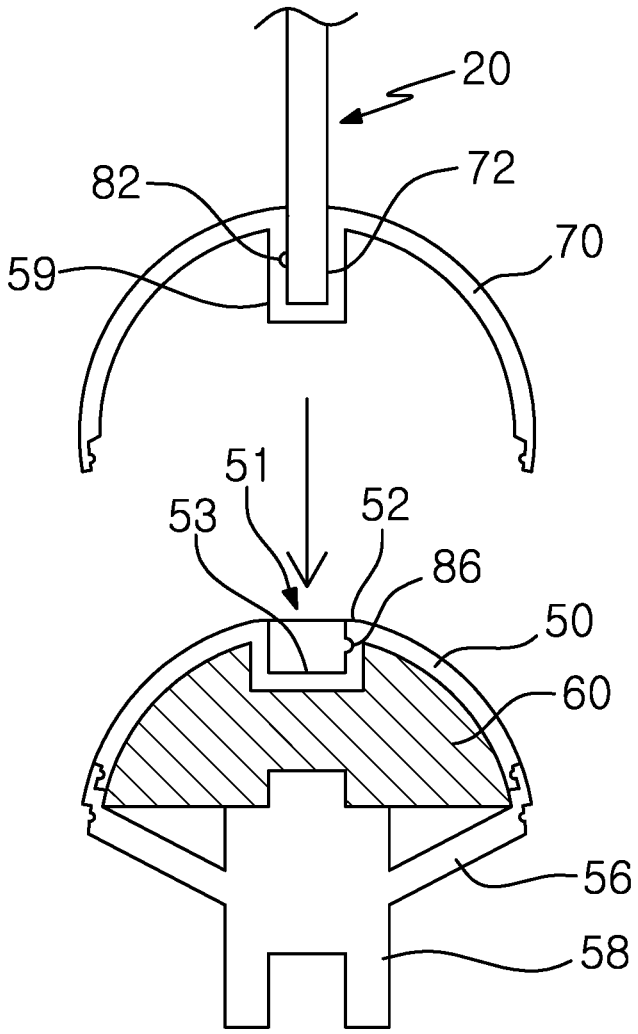

FIG. 6(*a*) is a cross-sectional view of the golf hole marker 1 according to still another embodiment of the present invention. FIG. 6(*b*) is a cross-sectional view of the golf hole marker 1 showing the top shell 70 detached from the bottom shell 50 and FIG. 6(*c*) shows the top shell 70 being attached to the recess 53 of the bottom shell 50. FIG. 8 shows the golf hole marker 1 being inserted into the socket of the golf cup 95.

The golf hole marker 1, having a self-righting structure, comprises a base 10, a weighting material 60, and a pole 20. The base 10 has a top shell 70 and a substantially spherically curved bottom shell 50. The weighting material 60 is received in the bottom shell 50 and the weighting material 60 lowers a center of mass of the golf hole marker 1 lower than a center of the spherically curved bottom shell 50. The pole 20 is, preferably detachably, attached to the top shell 70.

In this embodiment, the bottom shell 50 further comprises a rim 56 and a ferrule 58 integrated into the bottom shell 50. Alternatively, the rim 56 and ferrule 58 may be fixedly or detachably attached to the bottom shell 50 by an attachment means as shown in FIG. 6(*a*).

The top shell 70 is constructed to be attachable to the bottom shell 50 either over the ferrule 58 by a first shell attachment means 84 as in FIG. 6(*a*) or over a spherically curved portion of the bottom shell 50 by a second shell attachment means 86 as shown in FIG. 6(*c*) or FIG. 8.

Alternatively, the top shell 70 may be attachable to the ferrule 58 by an attachment means formed on the recess 59 of the ferrule 58 and outer surface of the passage 72. Preferably, the spherical portion of the top shell 70 is made of soft material, expandable to cover the spherically curved portion of the bottom shell when placed and attached to the ferrule 58.

The bottom shell 50 has a stabilizing bottom 51 to stabilize the golf hole marker 1 in a vertical position when the top shell 70 is attached to the bottom shell 50 over the ferrule 58 and the stabilizing bottom 51 is placed on a horizontal surface.

The rim 56 limits downward sliding of the ferrule 58 into a socket of a golf cup 95 when the top shell 70 is attached to the bottom shell 50 over the spherically curved portion of the bottom shell 50 and the ferrule 58 is inserted into the socket of the golf cup 95.

The top shell 70 has a passage 12 to receive a bottom portion 21 of the pole 20 and the ferrule 58 has a recess 59 to receive a bottom portion of the passage 72. Alternatively, a protuberance 74 may be formed below the passage 72 and the recess 59 of the ferrule 58 receives the protuberance 74.

A flag 30 and a direction pointer 40 are, preferably detachably, attached to a top portion 22 of the pole 20. Alternatively, the flag 30 may have a direction pointer.

The pole 20 may be telescopic and comprise a plurality of concentric tubular sections 24, 26, and 28 adapted to slide into one another.

The height of the golf hole marker 1 of the present invention is preferably smaller than 2 feet, more preferably smaller than 1 foot, and best stilt able for 6 to 10 inches.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A golf hole marker having a self-righting structure, comprising:

a base having a substantially spherically curved bottom shell wherein the bottom shell has a stabilizing bottom to stabilize the golf hole marker in a vertical position when the stabilizing bottom is placed on a horizontal surface;

a weighting material received in the bottom shell wherein the weighting material lowers a center of mass of the golf hole marker lower than a center of the spherically curved bottom shell; and a pole, wherein the base further comprises a top shell having a passage to receive a bottom portion of the pole and a protuberance to hold the weighting material for preventing the weighting material from moving within the bottom shell.

2. The golf hole marker of claim 1, wherein the stabilizing bottom is flat.

3. The golf hole marker of claim 1, wherein the stabilizing bottom comprises a circular ridge and a recess wherein the golf hole marker rests upon the circular ridge when placed on the horizontal surface.

4. The golf hole marker of claim 1, wherein the pole is attached to the top shell by a pole attachment means and the top shell is attached to the bottom shell by a first shell attachment means.

5. The golf hole marker of claim 1, wherein the weighting material is substantially spherically curved wherein the weighing material has a top surface and a recess formed on the top surface to receive a bottom of the protuberance.

6. The golf hole marker of claim 1, further comprising a flag attached to a top portion of the pole.

7. The golf hole marker of claim 1, further comprising a direction pointer attached to a top portion of the pole.

8. The golf hole marker of claim 1, wherein the pole is telescopic wherein the pole comprises a plurality concentric tubular sections adapted to slide into one another.

9. A golf hole marker having a self-righting structure, comprising:

a base which is hollow and substantially spherically curved wherein the base has a stabilizing bottom to stabilize the golf hole marker in a vertical position when the stabilizing bottom is placed on a horizontal surface;

a weighting material received in the base wherein the weighting material lowers a center of mass of the golf hole marker lower than a center of the spherically curved base; and a pole attached to the base, wherein the base has a top surface and a passage formed on the top surface to receive a bottom portion of the pole, wherein a bottom of the passage is received by a recess of the weighting material such that the passage holds the weighting material for preventing the weighting material from moving the base, wherein the weighting material is substantially spherically curved.

10. The golf hole marker of claim 9, further comprising a flag attached to a top portion of the pole.

11. The golf hole marker of claim 9, further comprising a direction pointer attached to a top portion of the pole.

12. The golf hole marker of claim 9, wherein the pole is telescopic wherein the pole comprises a plurality of concentric tubular sections adapted to slide into one another.

13. A golf hole marker having a self-righting structure, comprising:

a base having a top shell and a substantially spherically curved bottom shell wherein the bottom shell has a rim and a ferrule;

a weighting material received in the bottom shell wherein the weighting material lowers a center of mass of the golf hole marker lower than a center of the spherically curved bottom shell; and a pole attached to the top shell, wherein the top shell is constructed to be attachable to the bottom shell either over the ferrule by a first shell attachment means or over a spherically curved portion of the bottom shell by a second shell attachment means.

14. The golf hole marker of claim 13, wherein the bottom shell has a stabilizing bottom to stabilize the golf hole marker in a vertical position when the top shell is attached to the bottom shell over the ferrule and the stabilizing bottom is placed on a horizontal surface.

15. The golf hole marker of claim 13, wherein the rim limits downward sliding of the ferrule into a socket of a golf cup when the top shell is attached to the bottom shell over the spherically curved portion of the bottom shell and the ferrule is inserted into the socket of the golf cup.

16. The golf hole marker of claim 13, wherein the top shell has a passage to receive a bottom portion of the pole and the ferrule has a recess to receive a bottom portion of the passage.

17. The golf hole marker of claim 13, further comprising a flag and a direction pointer attached to a top portion of the pole.

18. The golf hole marker of claim 13, wherein the pole is telescopic wherein the pole comprises a plurality of concentric tubular sections adapted to slide into one another.

* * * * *